US012350575B1

(12) United States Patent
Hemink et al.

(10) Patent No.: US 12,350,575 B1
(45) Date of Patent: Jul. 8, 2025

(54) LIMB PROTECTOR

(71) Applicant: CASCADE MAVERIK LACROSSE, LLC, Liverpool, NY (US)

(72) Inventors: Doug Hemink, Camillus, NY (US); Ian Hefflefinger, Syracuse, NY (US); Kayla Deangelis, Camillus, NY (US)

(73) Assignee: CASCADE MAVERIK LACROSSE, LLC, Liverpool, NY (US)

( * ) Notice: Subject to any disclaimer, the term of this patent is extended or adjusted under 35 U.S.C. 154(b) by 0 days.

(21) Appl. No.: 18/409,887

(22) Filed: Jan. 11, 2024

Related U.S. Application Data

(60) Provisional application No. 63/617,475, filed on Jan. 4, 2024.

(51) Int. Cl.

| | |
|---|---|
| ***A41D 13/05*** | (2006.01) |
| ***A41D 13/08*** | (2006.01) |
| ***A63B 71/12*** | (2006.01) |
| *A63B 102/14* | (2015.01) |

(52) U.S. Cl.
CPC ..... *A63B 71/1225* (2013.01); *A41D 13/0543* (2013.01); *A41D 13/08* (2013.01); *A63B 2071/1258* (2013.01); *A63B 2102/14* (2015.10)

(58) Field of Classification Search
CPC ..... A63B 71/1225; A63B 2071/1258; A63B 2102/14; A41D 13/0543; A41D 13/08
See application file for complete search history.

(56) References Cited

U.S. PATENT DOCUMENTS

| | | | | |
|---|---|---|---|---|
| 2,367,657 | A * | 1/1945 | Boersma | B60R 3/002 24/453 |
| 3,735,419 | A * | 5/1973 | Byrd | A63B 71/1225 2/22 |
| 3,772,704 | A * | 11/1973 | Carbonneau | A63B 71/1225 2/22 |
| 5,446,926 | A * | 9/1995 | Bourque | A63B 71/12 411/509 |
| 5,561,857 | A * | 10/1996 | Hoshizaki | A63B 71/1225 2/22 |
| 5,652,956 | A * | 8/1997 | Hoshizaki | A63B 71/1225 2/22 |
| 5,711,028 | A * | 1/1998 | Bourque | A63B 71/1225 2/22 |
| 6,912,729 | B2 * | 7/2005 | Nishimoto | A63B 71/1225 2/22 |
| 2004/0083527 | A1 * | 5/2004 | Budda | A41D 13/08 2/22 |
| 2006/0107433 | A1 * | 5/2006 | Olson | A63B 71/08 2/22 |
| 2007/0044196 | A1 * | 3/2007 | Wang | A61F 13/06 2/24 |

(Continued)

FOREIGN PATENT DOCUMENTS

| | | | | |
|---|---|---|---|---|
| WO | WO-02066122 | A1 * | 8/2002 | A41D 13/0568 |
| WO | 2021092393 | A1 | 5/2021 | |

*Primary Examiner* — Khaled Annis
(74) *Attorney, Agent, or Firm* — BCF LLP

(57) ABSTRACT

A limb protector has a sheath having at least one elastic portion and a limb guard received in the sheath. The sheath defines a sheath aperture in a side thereof. The limb guard is removable from the sheath. The limb guard has a pad and a pin connected to the pad. The pin extends from an external side of the pad. The pin extends through the sheath aperture.

21 Claims, 15 Drawing Sheets

(56) References Cited

U.S. PATENT DOCUMENTS

| | | | | |
|---|---|---|---|---|
| 2016/0088882 | A1* | 3/2016 | Behrend | A63B 71/1225 2/2.5 |
| 2016/0183609 | A1* | 6/2016 | Cox | A41D 13/0568 2/22 |
| 2017/0119068 | A1* | 5/2017 | Beckenholdt | A62B 17/003 |
| 2019/0192954 | A1* | 6/2019 | Runzo | A63B 71/1225 |
| 2022/0322762 | A1* | 10/2022 | Wong | A41D 13/0543 |

* cited by examiner

LIMB PROTECTOR

CROSS-REFERENCE

The present application claims priority to U.S. Provisional Patent Application No. 63/617,475, filed Jan. 4, 2024, the entirety of which is incorporated herein by reference.

TECHNICAL FIELD

The present technology relates to limb protectors, and more specifically limb protectors to be worn by athletes while practicing a sport.

BACKGROUND

Many sports, such as lacrosse and ice hockey, require the athletes to wear limb protectors, such as arm protectors and/or leg protectors. Some limb protectors have one or more pads that can be attached around the limb using straps of hook and loop fasteners. Other limb protectors have an elastic sleeve sewn inside the pads. In such embodiments, the athlete inserts their limb inside the sleeve to put on the limb protector. Other limb protectors have both an elastic sleeve sewn inside the pads and one or more strap of hook and loop fasteners for additional adjustment.

Many sports teams have different jersey colors and/or designs, typically one for home games and another for away games. In some sports, like lacrosse for example, the limb protectors can be visible during play. As such, athletes need to have limb protectors of different colors and/or design to match the different jersey colors and/or designs of their team, or need to have a single color and/or design of limb protectors that goes with the different colors and/or designs used by their team. Similarly, if an athlete has limb protectors in the colors and/or design of one team, but then changes teams, they need to replace the limb protectors to match the colors and/or design of their new team.

In the case of limb protectors having a sleeve sewn inside the pad, washing the limb protector can be difficult as the entire limb protector needs to be washed every time. Also, should only the sleeve or only one of the pads become damaged, the entire limb protector needs to be replaced.

Therefore, there is a desire for a limb protector that can overcome at least some of the above-described drawbacks.

SUMMARY

It is an object of the present technology to ameliorate at least some of the inconveniences present in the prior art.

According to one aspect of the present technology, there is provided a limb protector having: a sheath having at least one elastic portion, the sheath defining a sheath aperture in a side thereof; and a limb guard received in the sheath. The limb guard is removable from the sheath. The limb guard has: a pad; and a pin connected to the pad, the pin extending from an external side of the pad, the pin extending through the sheath aperture.

In some embodiments, the pin has: a pin body having a first end and a second end, the first end of the pin body being connected to the pad, the pin body extending through the sheath aperture; and a pin head connected to the second end of the pin body.

In some embodiments, the pad defines an internal recess; the pin body extends through the pad; the first end of the pin body is disposed in the internal recess; and the limb guard also has a retaining ring clipped on the first end of the pin body for connecting the pin body to the pad, the retaining ring being disposed in the internal recess.

In some embodiments, the pad defines a channel on the external side thereof; and the pin head is disposed in the channel.

In some embodiments, the pin head is larger than the sheath aperture; and a portion of the sheath surrounding the sheath aperture is disposed between the pin head and the pad.

In some embodiments, the pin body is connected to the pin head at a point offset from a center of the pin head.

In some embodiments, the sheath has a plastic film around the sheath aperture for reinforcing the sheath around the sheath aperture and for reducing an elasticity of the sheath around the sheath aperture.

In some embodiments, the at least one elastic portion of the sheath has: a first elastic portion circumferentially aligned with the limb guard, the sheath aperture being defined in the first elastic portion; and a second elastic portion circumferentially offset from the limb guard, the second elastic portion being less elastic than at least a majority of the first elastic portion.

In some embodiments, the pad is disposed completely inside the sheath.

In some embodiments, the sheath has a longitudinal seam; the longitudinal seam is circumferentially offset from the limb guard; and the longitudinal seam is non-linear such that a first end of the longitudinal seam is circumferentially offset from a second end of the longitudinal seam.

In some embodiments, the limb protector is an arm protector; the sheath is a sleeve; and the limb guard is an arm guard.

In some embodiments, the pad is a bicep pad. The arm guard also has: an elbow cap connected to the bicep pad; and a forearm pad connected to the elbow cap, the elbow cap being disposed between the bicep pad and the forearm pad.

According to another aspect of the present technology, there is provided a limb guard having: a pad; and a pin connected to the pad, the pin extending from an external side of the pad.

In some embodiments, the pin has: a pin body having a first end and a second end, the first end of the pin body being connected to the pad; and a pin head connected to the second end of the pin body.

In some embodiments, the pad defines an internal recess; the pin body extends through the pad; the first end of the pin body is disposed in the internal recess; and the limb guard also has comprises a retaining ring clipped on the first end of the pin body for connecting the pin body to the pad, the retaining ring being disposed in the internal recess.

In some embodiments, the pad defines a channel on the external side thereof; and the pin head is disposed in the channel.

In some embodiments, the pin body is connected to the pin head at a point offset from a center of the pin head.

In some embodiments, the limb guard is an arm guard; and the pad is a bicep pad. The arm guard also has: an elbow cap connected to the bicep pad; and a forearm pad connected to the elbow cap, the elbow cap being disposed between the bicep pad and the forearm pad.

According to another aspect of the present technology, there is provided a sheath for a limb protector having: a generally tubular sheath body configured for receiving a limb guard therein, the sheath body having at least one elastic portion, the sheath body defining a sheath aperture in a side thereof, the sheath aperture being configured for receiving therethrough a pin of the limb guard.

In some embodiments, a plastic film disposed on the sheath body around the sheath aperture for reinforcing the sheath body around the sheath aperture and for reducing an elasticity of the sheath body around the sheath aperture.

In some embodiments, the at least one elastic portion of the sheath body has: a first elastic portion configured to be circumferentially aligned with the limb guard, the sheath aperture being defined in the first elastic portion; and a second elastic portion configured to be circumferentially offset from the limb guard, the second elastic portion being less elastic than at least a majority of the first elastic portion.

In some embodiments, the sheath body has a longitudinal seam; and the longitudinal seam is non-linear such that a first end of the longitudinal seam is circumferentially offset from a second end of the longitudinal seam.

In the context of the present specification, unless expressly provided otherwise, the words "first", "second", "third", etc. have been used as adjectives only for the purpose of allowing for distinction between the nouns that they modify from one another, and not for the purpose of describing any particular relationship between those nouns.

It must be noted that, as used in this specification and the appended claims, the singular form "a", "an" and "the" include plural referents unless the context clearly dictates otherwise.

As used herein, the term "about" in the context of a given value or range refers to a value or range that is within 20%, preferably within 10%, and more preferably within 5% of the given value or range.

As used herein, the term "and/or" is to be taken as specific disclosure of each of the two specified features or components with or without the other. For example, "A and/or B" is to be taken as specific disclosure of each of (i) A, (ii) B and (iii) A and B, just as if each is set out individually herein.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
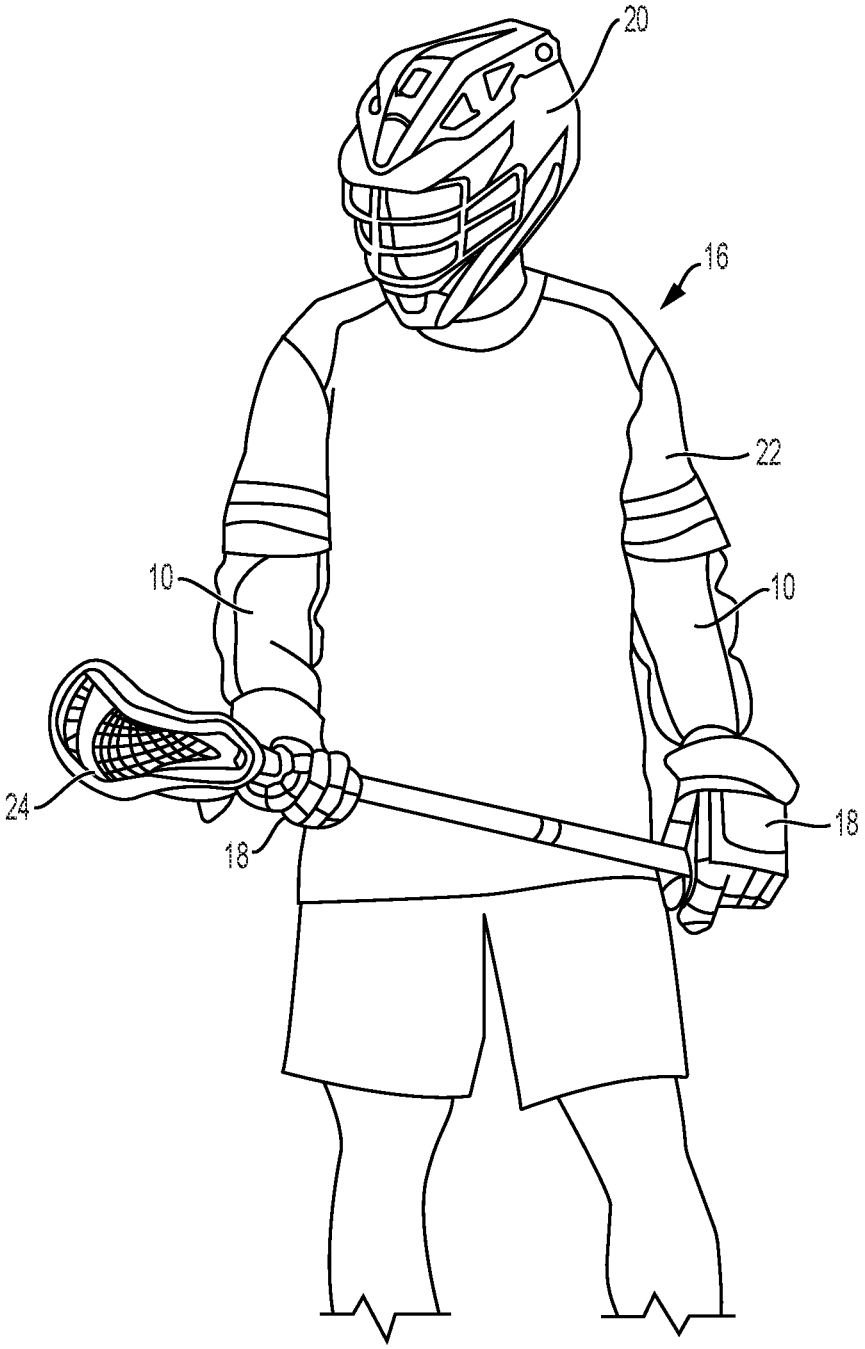
FIG. 1 illustrates a lacrosse player wearing arm protectors according to the present technology.

The present disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including", "comprising", or "having", "containing", "involving" and variations thereof herein, is meant to encompass the items listed thereafter as well as, optionally, additional items. In the following description, the same numerical references refer to similar elements.

The present technology will be described with reference to two different limb protectors: an arm protector 10 intended for lacrosse, and a shin protector 200 intended for soccer. Both types of limb protectors have a limb guard that is inserted in a sheath having at least one elastic portion. The limb guard can be removed from the sheath, thereby allowing the sheath to be washed independently from the limb guard. This construction also allows for easy replacement of the sheath by another sheath of a different color and/or having a different design, such has a different team name and logo. This construction also allows for easy replacement of only one of the limb guards and the sheath should only one of the two become worn or damaged. In the arm protector 10, the limb guard is an arm guard 12 and the sheath is a sleeve 14. In the shin protector 200, the limb guard is a shin guard 202 and the sheath is a leg portion 204 of a sock 206. The arm protector 10 and the shin protector 200 will be described in greater detail below. Although not described in detail herein, other types of limb protectors are contemplated such as, but not limited to, elbow and shin protectors intended for ice hockey, and elbow protectors intended for baseball or softball.

FIG. 1 illustrates a lacrosse player 16 wearing left and right arm protectors 10, gloves 18, a helmet 20, a short sleeve jersey 22, and shoulder pads (not shown) under the jersey 22. The player 16 holds a lacrosse stick 24. It will be noted that the arm protectors 10 are visible as they extend passed the sleeves of the jersey 22.

The left arm protector 10 will now be described in detail with reference to FIGS. 2 to 14B. The right arm protector 10 is a mirror image of the left arm protector 10 and as such will not be described in detail herein.

Figure 2:
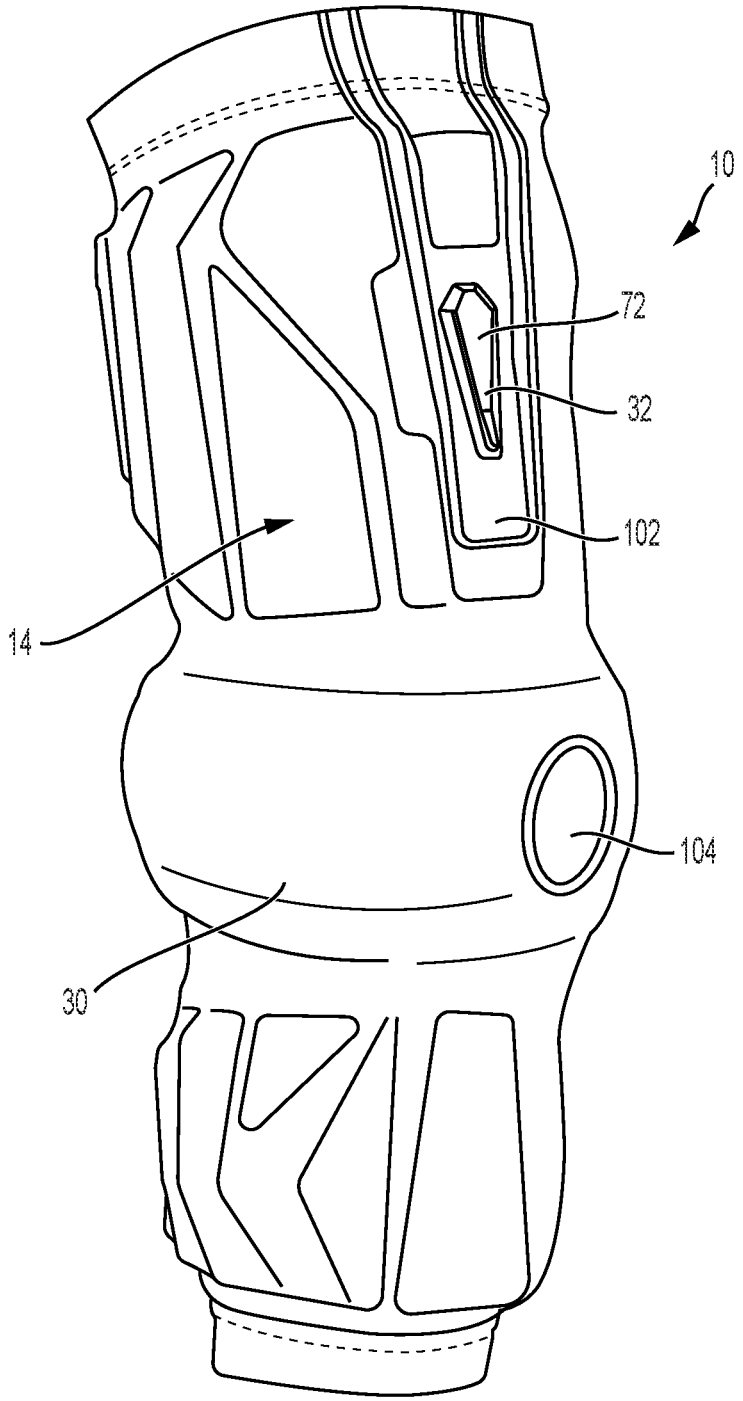
FIG. 2 is a perspective view of a left arm protector according to the present technology.
Figure 3:
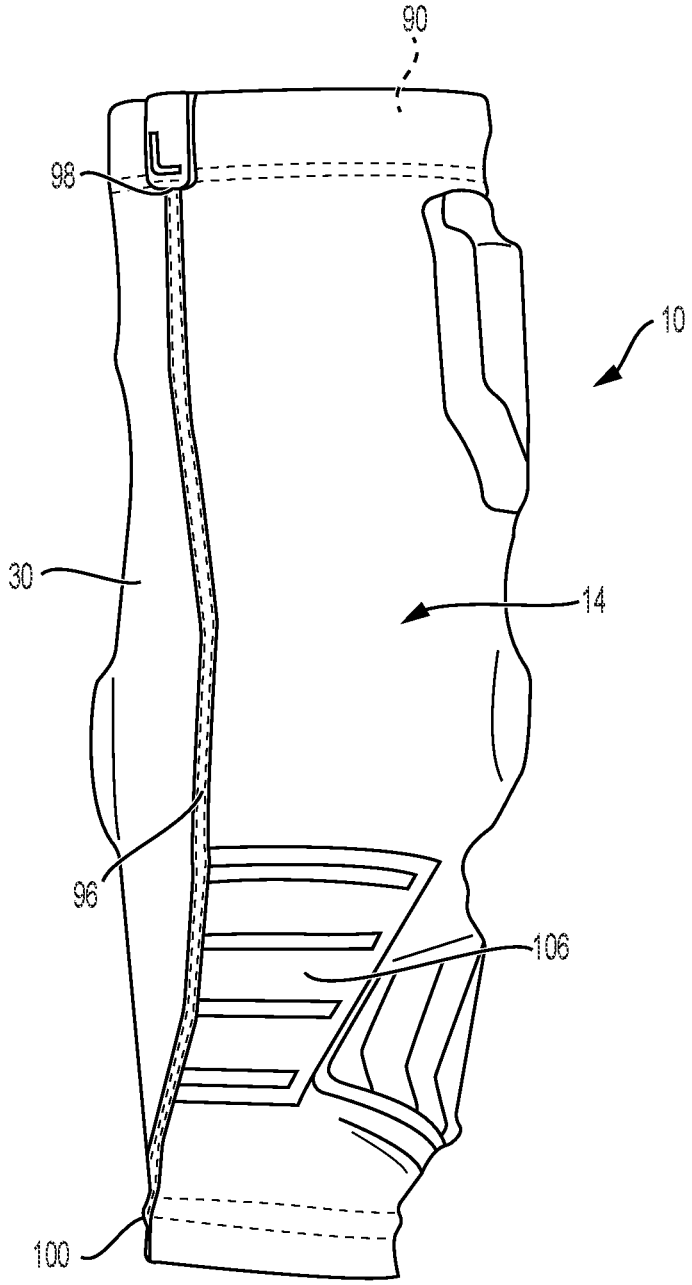
FIG. 3 is another perspective view of the left arm protector of FIG. 2.

The sleeve 14 has a generally tubular sheath body 30 made from elastic material. It is contemplated that not every portion of the sheath body 30 could be made from elastic material. As a result of the sheath body being elastic, when the arm guard 12 is received in the sleeve 14 to form the arm protector 10, the sleeve 14 fits tightly around the arm guard 12 as can be seen in FIGS. 2 and 3. The elasticity of the sheath body 30 also presses the arm guard 12 on the arm of the player 16 wearing the arm protector 10, thereby helping to keep the arm protector 10 in position.

As will be described in more detail below, the arm guard 12 has a pin 32 that extends through a sheath aperture 34 (FIG. 6) defined in a side of the sheath body 30. The pin 32 helps to properly align the sleeve 14 over the arm guard 12 when installing the sleeve 14 over the arm guard 12 and also helps maintain the sleeve 14 in position over the arm guard 12. As can be seen in FIGS. 2 and 3, except for the pin 32, the sleeve 14 covers the entire arm guard 12. It is contemplated that in other embodiments, portions of the arm guard 12 other than the pin 32 could also not be covered by the sleeve 14.

With reference to FIGS. 4, 5, 7A and 8A, the arm guard 12 will now be described in more detail. The arm guard 12 has a forearm pad 36, an elbow cap 38 and a bicep pad 40, and an inner padding 42. The elbow cap 38 is disposed between and is connected to the forearm pad 36 and the bicep pad 40. The inner padding 42 is connected to an internal side of the forearm pad 36, the elbow cap 38 and the bicep pad 40. In the present embodiment, the forearm pad 36, the elbow cap 38 the bicep pad 40 and the inner padding 42 are sewn together, but it is contemplated that they could be connected to each other via other means. When the arm protector 10 is worn by the player 16, the forearm pad 36 covers part of a forearm of the player 16, the elbow cap 38 covers the elbow of the player 16, and the bicep pad 40 covers part of the upper arm of the player 16. In the present embodiment, the forearm pad 36 and the bicep pad are made from thermal compression molded foam, but other materials are contemplated. In the present embodiment, the elbow cap 38 is made from molded polyethylene and foam layers, but other materials are contemplated. Although the elbow cap 38 is referred to herein as a "cap", the elbow cap 38 is also considered to be a pad as it pads the elbow of the player 16.

The forearm pad 36 has a main portion 44 and a wing portion 46 connected to one side of the main portion 44. The main portion 44 defines a channel 48 on an external side thereof. A ventilation aperture 50 is defined in the channel 48 near the elbow cap 38. The wing portion 46 has a plurality of ribs 52. It is contemplated that in some embodiments, the channel 48 and/or the ventilation aperture 50 and/or the ribs 52 could be omitted. It is contemplated that is some embodiments, the main portion 44 and the wing portion 46 could be formed as a single part. It is also contemplated that in some embodiments, the forearm pad 36 could be formed by more than two portions connected to each other. For example, it is contemplated that in addition to the wing portion 46, another wing portion could be connected on the opposite side of the main portion 44.

Similarly, the bicep pad 40 has a main portion 54 and a wing portion 56 connected to one side of the main portion 54. The main portion 54 defines a channel 58 on an external side thereof. A ventilation aperture 60 is defined in the channel 58 near the elbow cap 38. The pin 32 is disposed in the channel 58. The wing portion 56 has a plurality of ribs 62. It is contemplated that in some embodiments, the channel 58 and/or the ventilation aperture 60 and/or the ribs 62 could be omitted. It is contemplated that is some embodiments, the main portion 54 and the wing portion 56 could be formed as a single part. It is also contemplated that in some embodiments, the bicep pad 40 could be formed by more than two portions connected to each other. For example, it is contemplated that in addition to the wing portion 56, another wing portion could be connected on the opposite side of the main portion 54.

It is contemplated that in some embodiments, the pin 32 could be disposed on the wing portion 56 of the bicep pad 40. It is also contemplated that in other embodiments, the pin 32 could be disposed on the main portion 44 or on the wing portion 46 of the forearm pad 36. It is also contemplated that in other embodiments, the pin 32 could be disposed on the elbow cap 38.

An arm guard 12 for a right arm protector 10 can be manufactured using the same main portions 44 and 54 of the forearm pad 36 and the bicep pad 40 as the arm guard 12 of the left arm protector 10, but with wing portions 46 and 56 that are mirror images of the wing portion 46 and 56 of the arm guard 12 of the left arm protector 10 that are connected to the opposite side of the main portions 44 and 54.

Figure 7B:
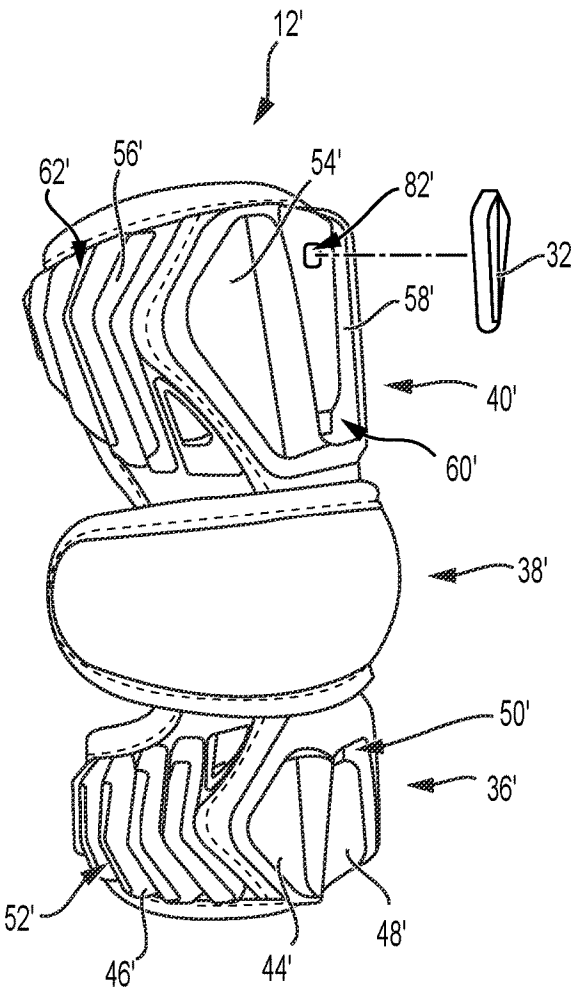
FIG. 7B is a partially exploded view of an alternative embodiment of the arm guard of FIG. 5.
Figure 7A:
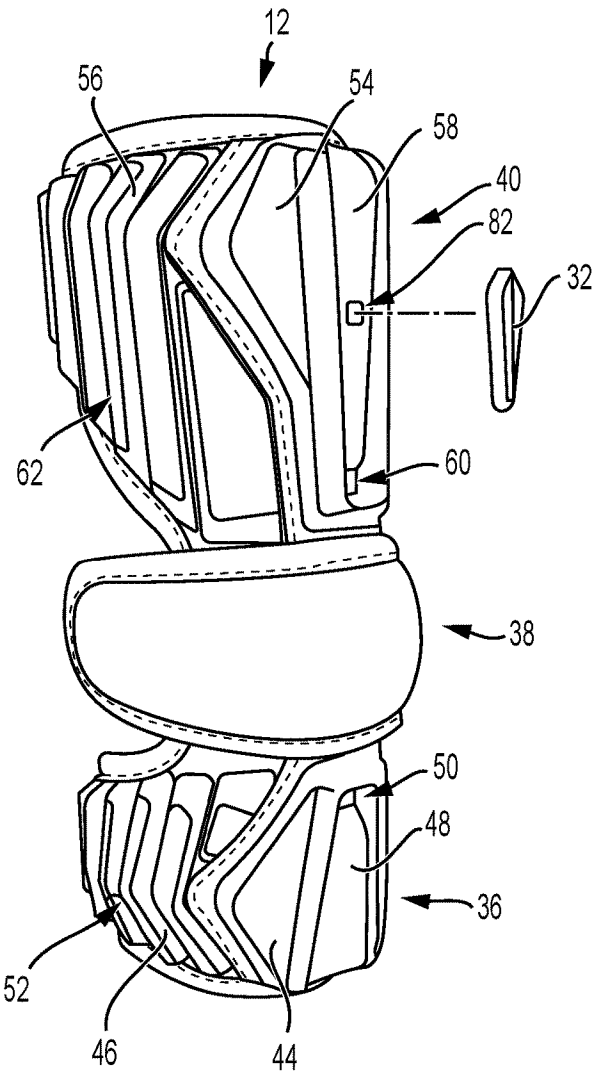
FIG. 7A is a partially exploded view of the arm guard of FIG. 5.
Figure 8A:
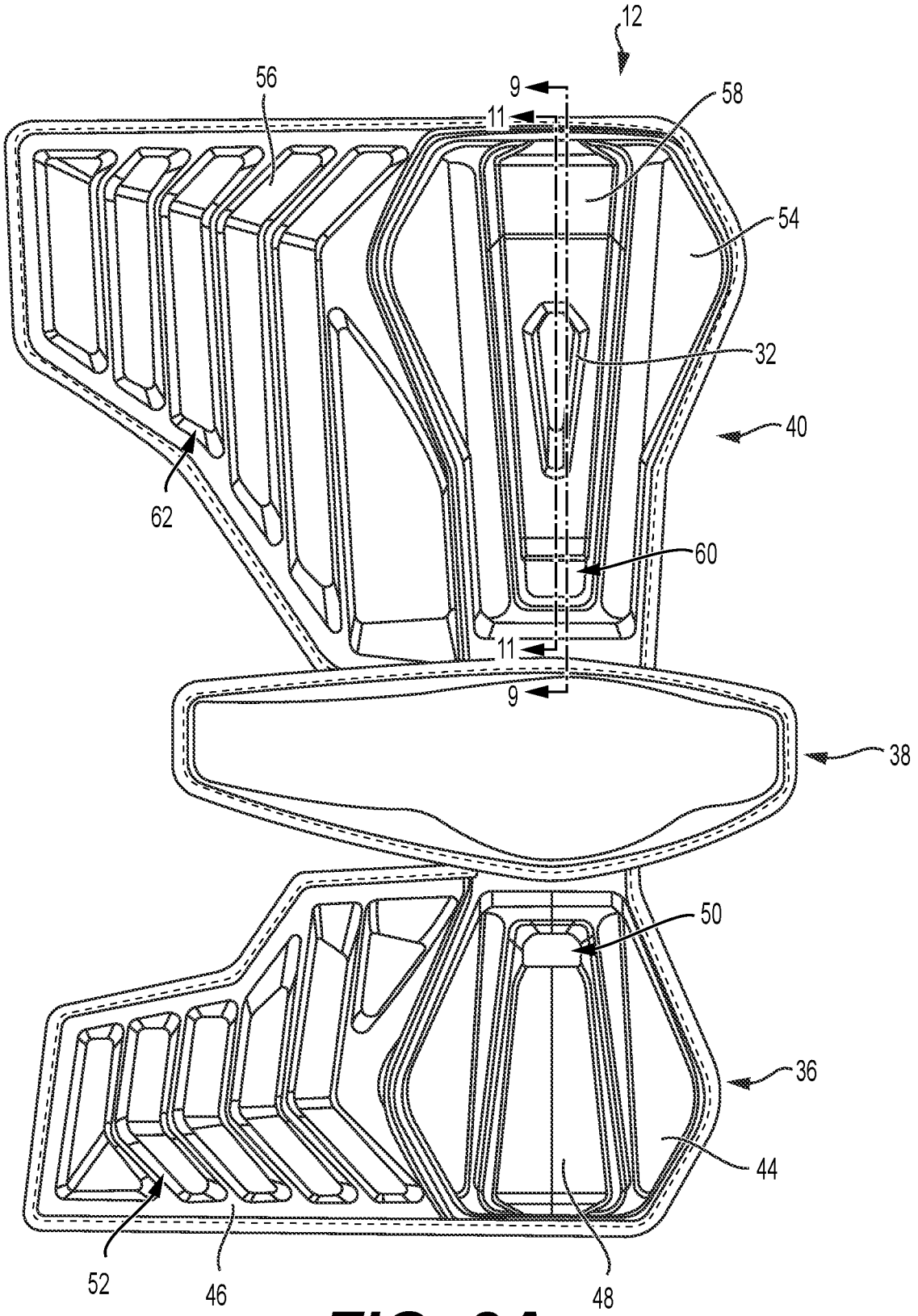
FIG. 8A is a view of an external side of the arm guard of FIG. 7A laid flat against a surface.
Figure 8B:
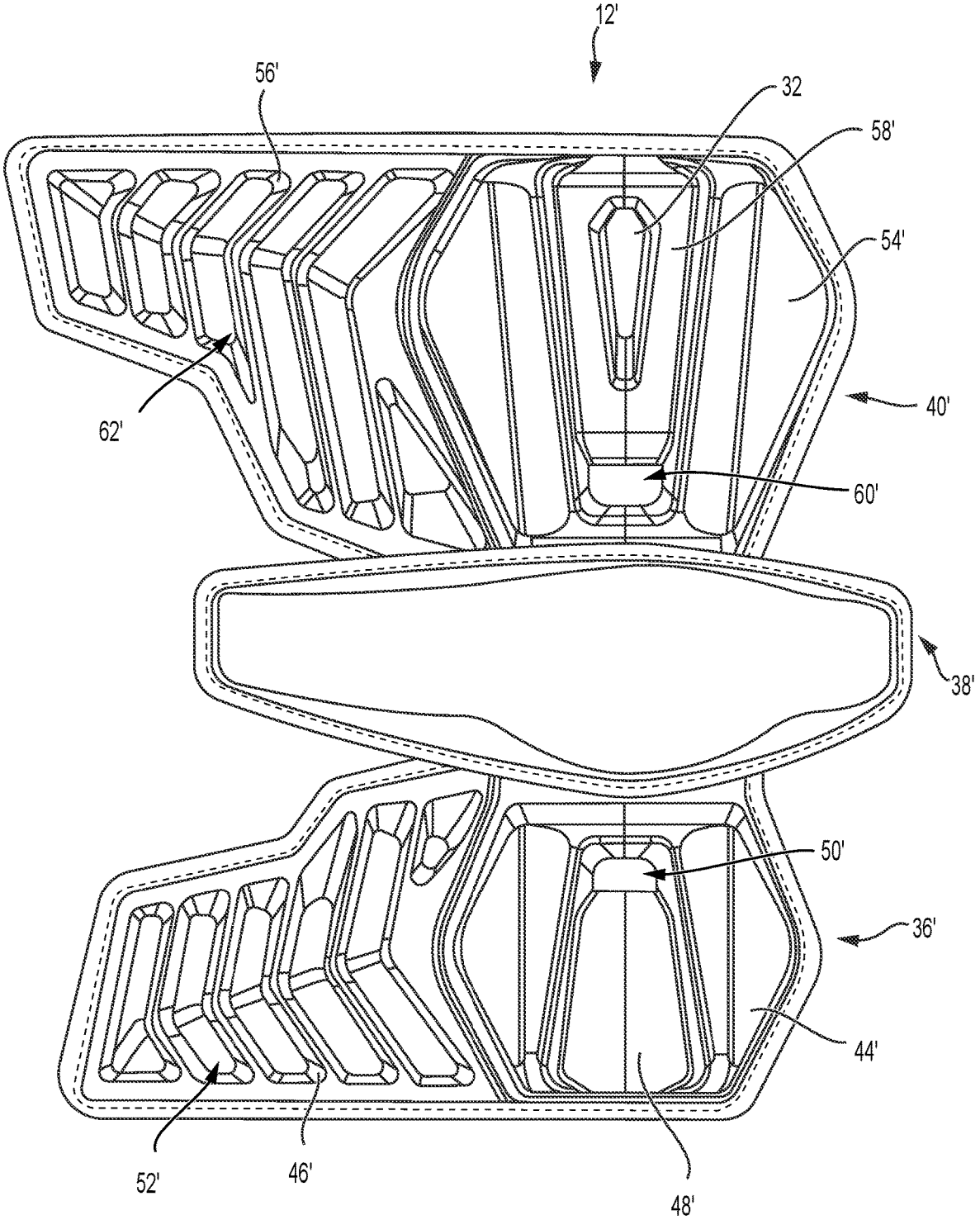
FIG. 8B is a view of an external side of the arm guard of FIG. 7B laid flat against a surface.

FIGS. 7B and 8B illustrate an arm guard 12' that is an alternative embodiment of the arm guard 12 described above. The arm guard 12' is shorter than the arm guard 12 as some players prefer shorter arm protectors. As such, the arm guard 12' has elements that are similar to those of the arm guard 12 but have different shapes and dimensions. Therefore, for simplicity, the elements of the arm guard 12' will not be described in detail herein. The elements of the arm guard 12' that correspond to the elements of the arm guard 12 have been labeled with the same reference numerals as those of the arm guard 12, but followed by an apostrophe. For example, the forearm pad 36 of the arm guard 12, is a forearm pad 36' in the arm guard 12'. The pin 32 is the same in the arm guard 12' as in the arm guard 12. Since both arm guards 12 and 12' have the same pin 32, and since the sleeve 14 is made of elastic material, the arm guard 12' can also be received in the sleeve 14. It is contemplated that a sleeve that is similar to but shorter than the sleeve 14 could also be provided to receive the arm guard 12'.

Figure 11:
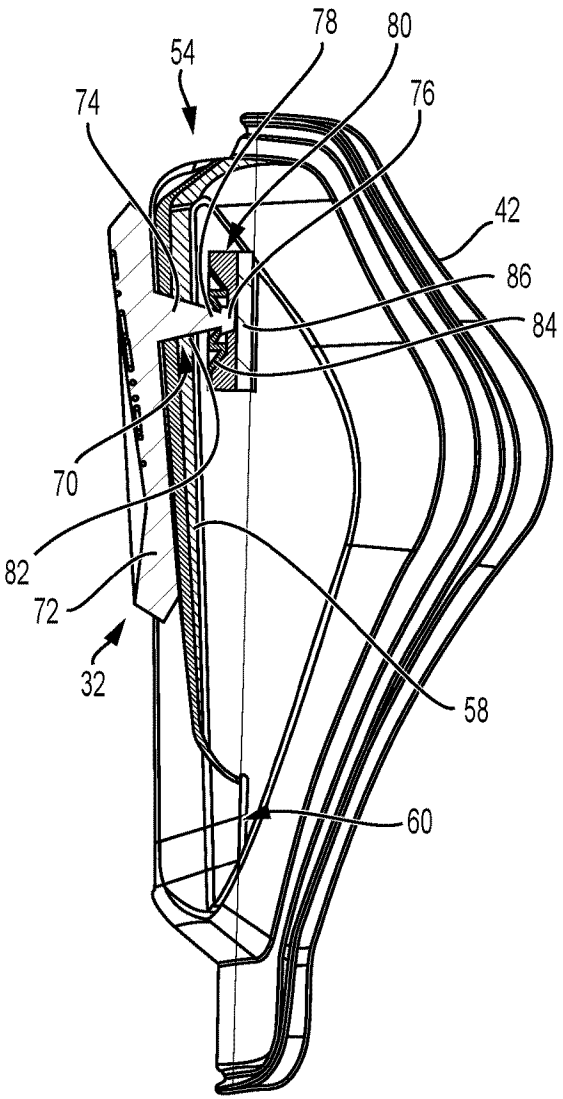
FIG. 11 is a cross-section of the main portion of the bicep pad of FIG. 8A, taken along line 11-11 of FIG. 8A.
Figure 10:
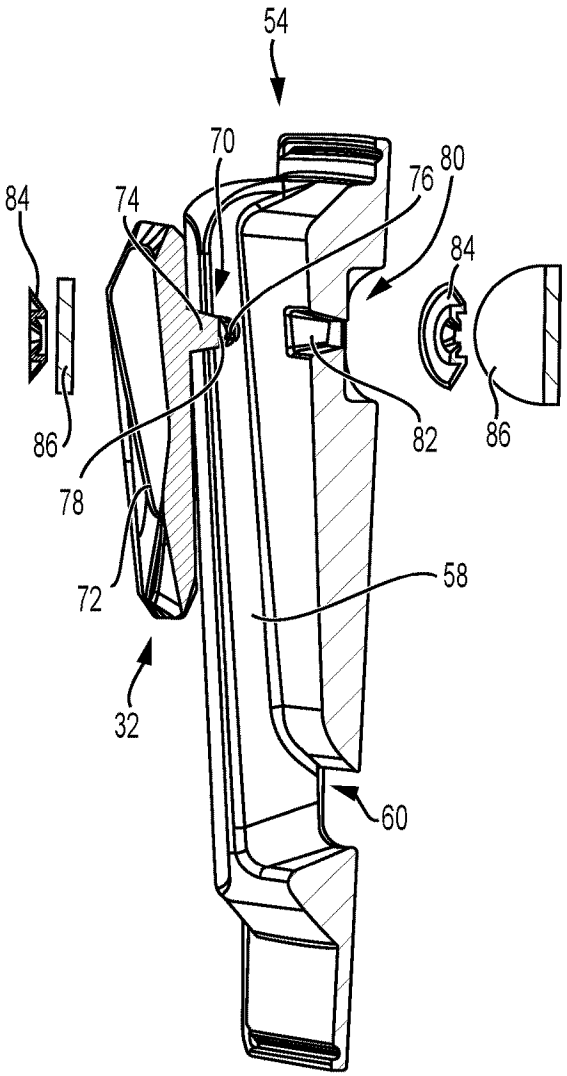
FIG. 10 is a perspective view of the cross-section of FIG. 10, with an inner padding of the bicep pad being omitted.
Figure 9:
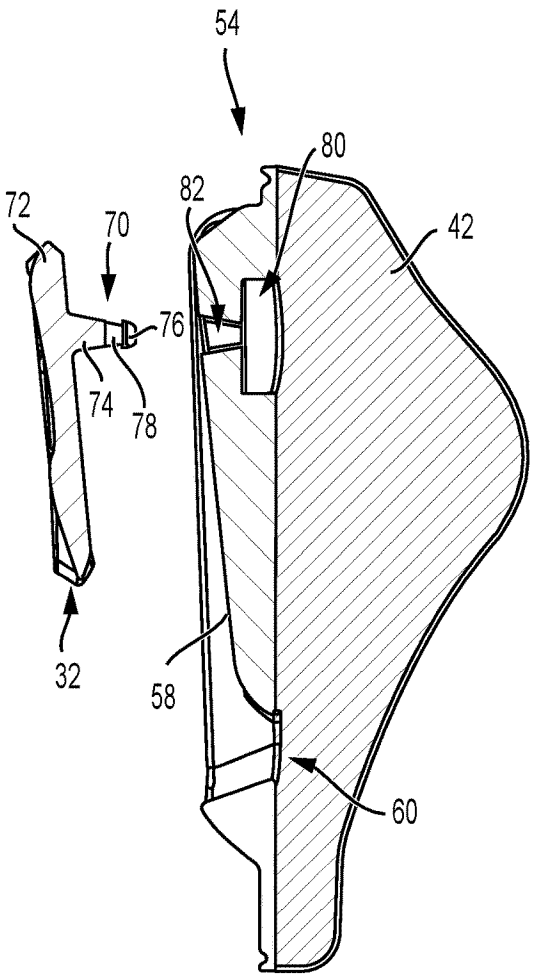
FIG. 9 is a partially exploded cross-section of a main portion of a bicep pad of the arm guard of FIG. 8A taken along line 9-9 of FIG. 8A.

Turning now to FIGS. 9 to 11, the pin 32 and a connection of the pin 32 to the main portion 54 of the bicep pad 40 will be described in more detail. The pin 32 is made from plastic, but other materials are contemplated. The pin 32 has a pin body 70 and a pin head 72 connected to one end of the pin body 70. The pin body 70 is connected to the pin head 72 at a point that is offset from a center of the pin head 72. More specifically, the pin body 70 is connected to the pin head 72 at a point that is laterally centered on the pin head 72, but that is vertically closer to an upper end of the pin head 72 than to the lower end of the pin head 72. In the present embodiment, the pin body 70 and the pin head 72 are connected by being integrally formed together. It is contemplated that the pin body 70 could be connected to the pin head 72 by other means. For example, the pin body 70 could be clipped to the pin head 72. It is contemplated that in alternative embodiments, the pin body 70 could be connected to the pin head 72 elsewhere, including at the center of the pin head 72.

A shape of the pin head 72 is that of an irregular convex hexagon that is symmetric about its longitudinal axis, as best seen in FIG. 8A. It is contemplated that the pin head 72 could have other shapes such as, for example, circular, oval, and triangular.

A portion 74 of the pin body 70 that is connected to the pin head 72 is frusto-pyramidal and tapers as it extends away from the pin head 72. The free end 76 of the pin body 70 is a protrusion having the shape of a truncated hemisphere. The portion 78 of the pin body 70 extending between the portion 74 and the free end 76 is frusto-conical and tapers as it extends from the portion 74 to the free end 76. It is contemplated that the pin body 70 could have a different configuration.

The main portion 54 of the bicep pad 40 defines an internal recess 80 and an aperture 82. The aperture 82 opens in the channel 58 and extends from the external surface of the bicep pad 40 to the internal recess 80. The aperture 82 is frusto-conical to match the shape of the portion 74 of the pin body 70. As seen in FIG. 11, the pin body 70 extend through the bicep pad 40 via the aperture 82 such that the free end 76 of the pin body 70 is disposed in the internal recess 80. As the sides of the frusto-conical portion 74 engage the sides of the frusto-conical aperture 82, the pin body 80 is prevented from rotating inside the aperture 82. To connect the pin body 70 to the bicep pad 40, a retaining ring 84 is pushed over the free end 76 such that the retaining ring 84 is clipped to the free end 76 of the pin body 40. In the present embodiment, the retaining ring 84 is a push-on retaining ring, but other types of retaining rings are contemplated. The retaining ring 84 is disposed inside the internal recess 80 and abut the internal side of the main portion 54 of the bicep pad 40. A foam insert 86 is provided in the internal recess 80 over the free end 76 of the pin body 70 and the retaining ring 84. In one embodiment, the foam insert 86 is held in place by being connected by hoop and loop fasteners to the inner padding 42. It is contemplated that the foam insert 86 could be omitted. It is contemplated that the pin body 70 could be connected to the bicep pad 40 differently. For example, the free end 76 of the pin body 70 could be threaded and the retaining ring 84 could be replaced by a nut.

As can be seen in FIG. 11, the pin body 70 extends from the external surface of the main portion 54 of the bicep pad 40 such that the pin head 72 is disposed in the channel 58 and is spaced from the external surface of the main portion 54.

Figure 6:
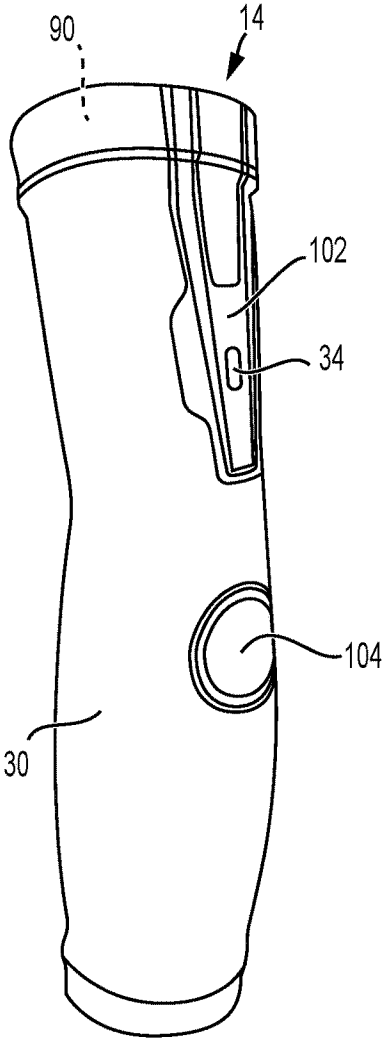
FIG. 6 is a perspective view of a sleeve of the arm protector of FIG. 2.
Figure 12A:
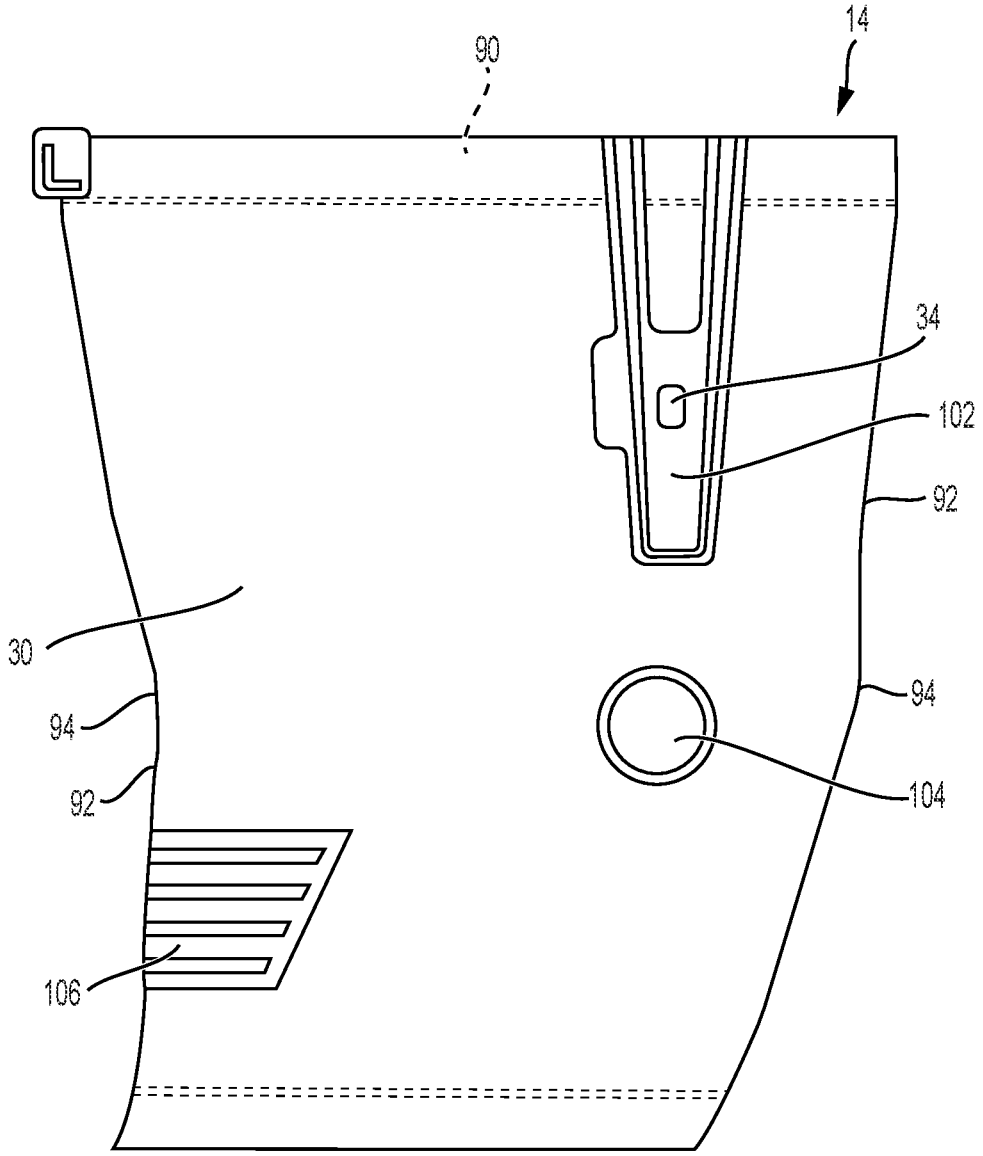
FIG. 12A illustrates the fabric laid flat prior to being sewn to form the sleeve of FIG. 6.

Turning now to FIGS. 2, 6 and 12A, the sleeve 14 will now be described in more detail. As previously described, the sleeve 24 has a sheath body 30 defined in a sheath aperture 34 defined in a side thereof. In the present embodiment, the sheath body 30 is made from moisture wicking material that is a mix of polyester and spandex, but other materials are contemplated. An elastic band 90 is sewn in the top end of the sheath body 30. It is contemplated that the elastic band 90 could be omitted. It is contemplated that an elastic band could also be sewn inside the lower end of the sheath body 30. As can be seen in FIG. 12A, the side edges 92 of the sheath body 30 prior to being sewn for forming the generally tubular sleeve 14 are not straight. With reference to the orientation in FIG. 12A, the upper part of the left side edge 92 is at a greater angle from vertical than the upper part of the right side edge 92, and the lower part of the left side edge 92 is at a smaller angle from vertical than the lower part of the right side edge 92. Both side edges 92 have a turning point 94 located in the elbow region of the sleeve 14. When the side edges 92 are sewn together to form the sleeve 14, the resulting longitudinal seam 96 is non-linear as can be seen in FIG. 3. As can be seen, the upper end 98 of the seam 96 is circumferentially offset from the lower end 100 of the seam 96. With the arm guard 12 received in the sleeve 14, the longitudinal seam 96 is circumferentially offset from the arm guard 12. In other words, the longitudinal seam 96 extends along the part of the sleeve 14 that extends between the sides of the arm guard 12 and that does not abut the arm guard 12.

Figure 4:
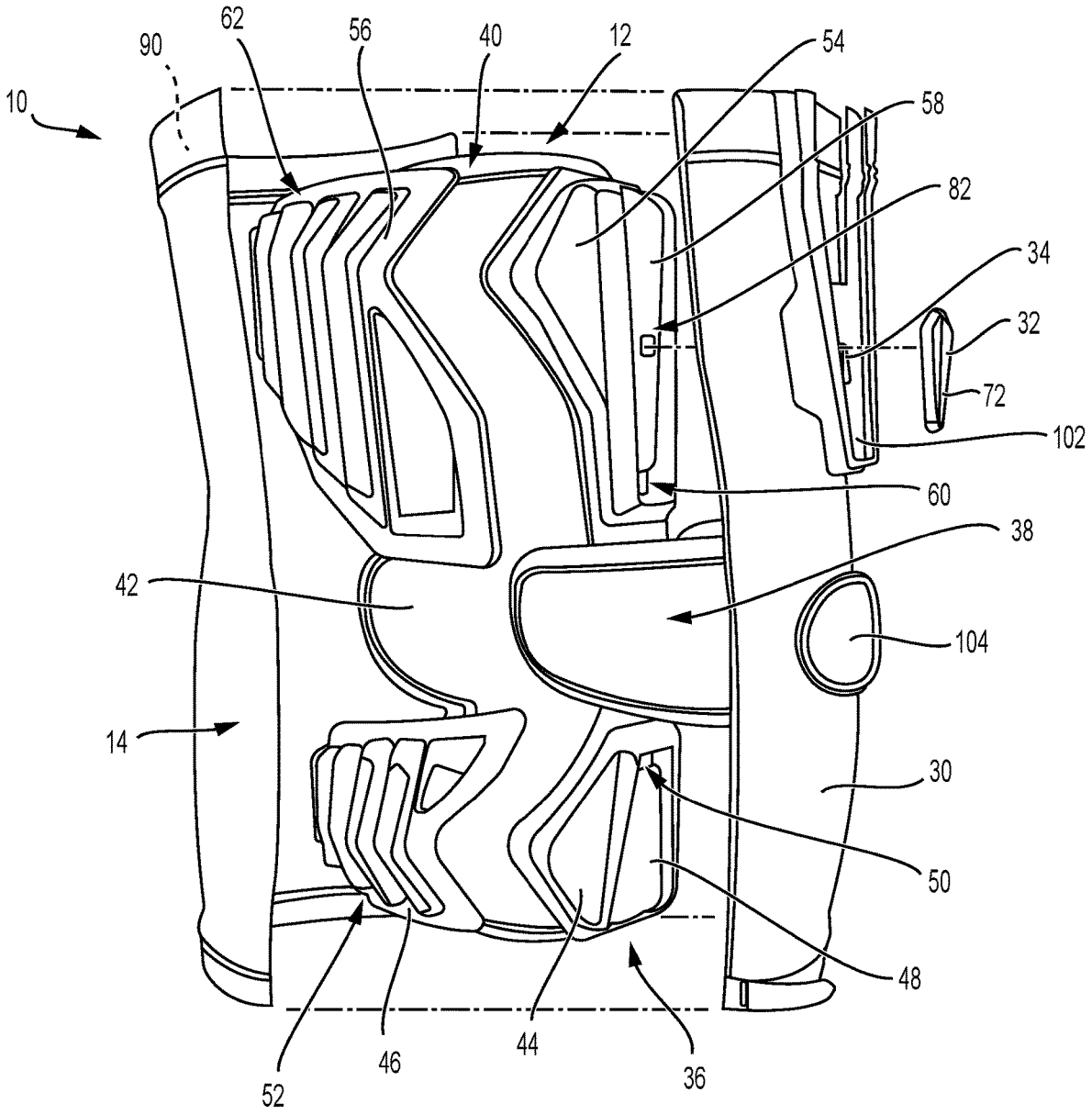
FIG. 4 is an exploded view of the left arm protector of FIG. 2.
Figure 5:
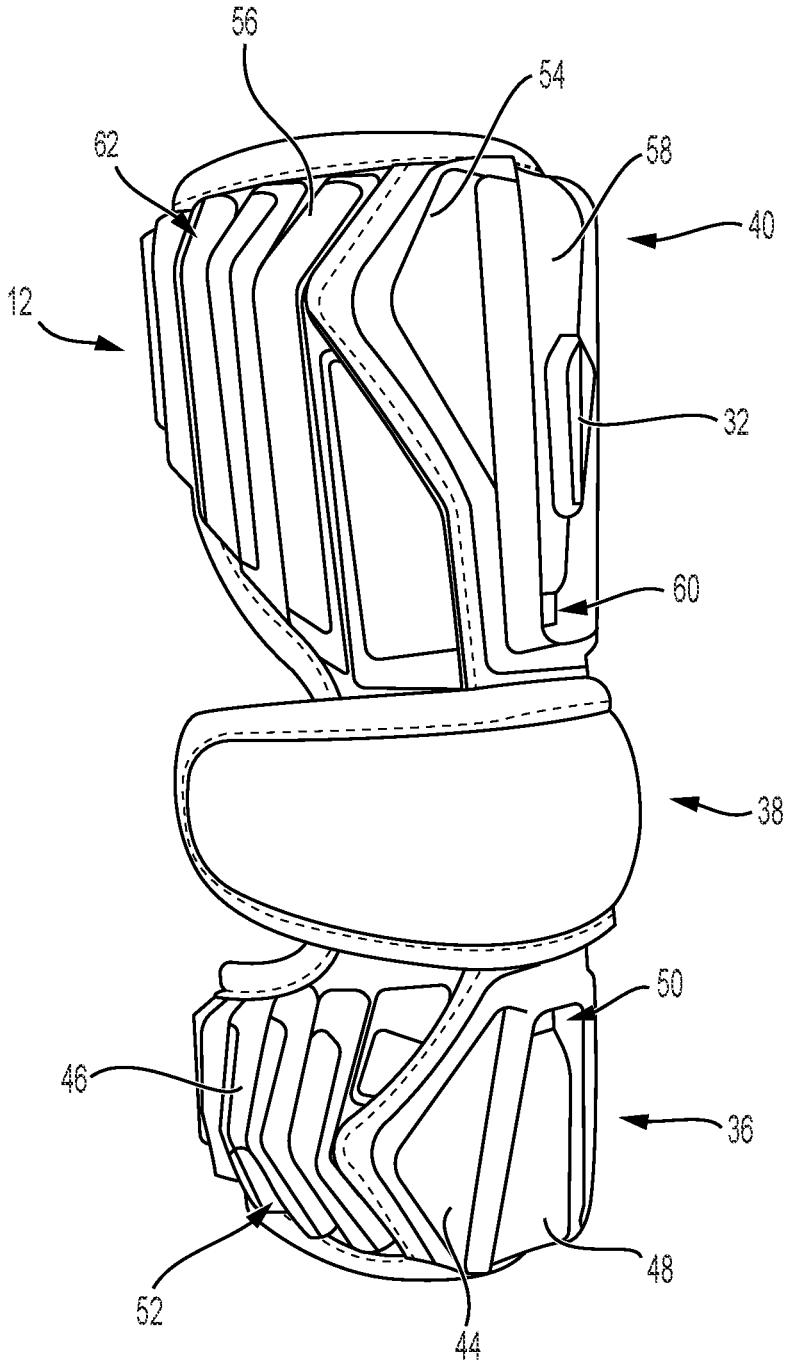
FIG. 5 is a perspective view of an arm guard of the arm protector of FIG. 2.

The sheath aperture 34 has the shape of a rounded rectangle. It is contemplated that the sheath aperture 34 could have another shape, such as, for example, round, oval, and square. The pin head 72 is larger than the sheath aperture 34. The sheath aperture 34 is larger than the portion of the pin body 70 that extends through it. It is contemplated that, prior to installing the arm guard 12 inside the sleeve 14, the sheath aperture 34 could be smaller than the pin body 70, but that the portion of the sheath body surrounding the sheath aperture 34 could stretch around the pin body 70 when the pin body 70 extends through the sheath aperture 34. When the arm guard 12 is installed in the sleeve 14 as will be described below, the portion of the sheath body 34 surrounding the sheath aperture 34 is disposed between the pin head 72 and the bicep pad 40, as can be seen in FIGS. 2 and 4.

A plastic film 102 is provided on the sheath body 30 around the sheath aperture 34 for reinforcing the sheath body 30 around the sheath aperture 34 and for reducing the elasticity of the sheath body 30 around the sheath aperture 34. In the present embodiment, the plastic film 102 is a thermoplastic polyurethane (TPU) film. It is contemplated that the plastic film 102 could be omitted. It is contemplated that the portion of the sheath body 30 around the sheath aperture 34 could additionally or alternatively be reinforced and be made less elastic by providing stitches around the sheath aperture 34, by connecting another type of material to the sheath body 30 around the sheath aperture 34, by making the material of the sheath body 30 around the sheath aperture 34 with a weave that is more resistant and less elastic, or combinations thereof.

A circular plastic film 104 is provided on the sheath body 30 at a location that is aligned with the elbow cap 38 when the arm guard 12 is installed in the sleeve 14 for reinforcing the sheath body 30 at this location. In the present embodiment, the plastic film 104 is a TPU film. It is contemplated that the plastic film 104 could be omitted. It is contemplated that the elbow portion of the sheath body 30 could additionally or alternatively be reinforced by providing stitches at this location, by connecting another type of material to the sheath body 30 at this location, by making the material of the sheath body 30 at this location with a weave that is more resistant, or combinations thereof.

A trapezoidal plastic film 106 is provided on the sheath body 30 at a location adjacent the seam 96 on the forearm region of the sleeve for reducing the elasticity of the sheath body 30 at this location. In the present embodiment, the plastic film 106 is a TPU film. It is contemplated that this of the sheath body 30 could additionally or alternatively be reinforced by providing stitches at this location, by connecting another type of material to the sheath body 30 at this location, by making the material of the sheath body 30 at this location with a weave that is less elastic, or combinations thereof.

With reference to FIG. 3, it can be seen that, with the arm guard 12 received in the sleeve 14, the plastic film 106 is circumferentially offset from the arm guard 12. In other words, the plastic film 106 extends along the part of the sleeve 14 that extends between the sides of the arm guard 12 and that does not abut the arm guard 12. As such, the part of the sheath body 30 having the plastic film 106 is less elastic than a majority of the portion of the sheath body 30 that are circumferentially aligned with the arm guard 12 (i.e., other than the parts having the films 102, 104).

Figure 12B:
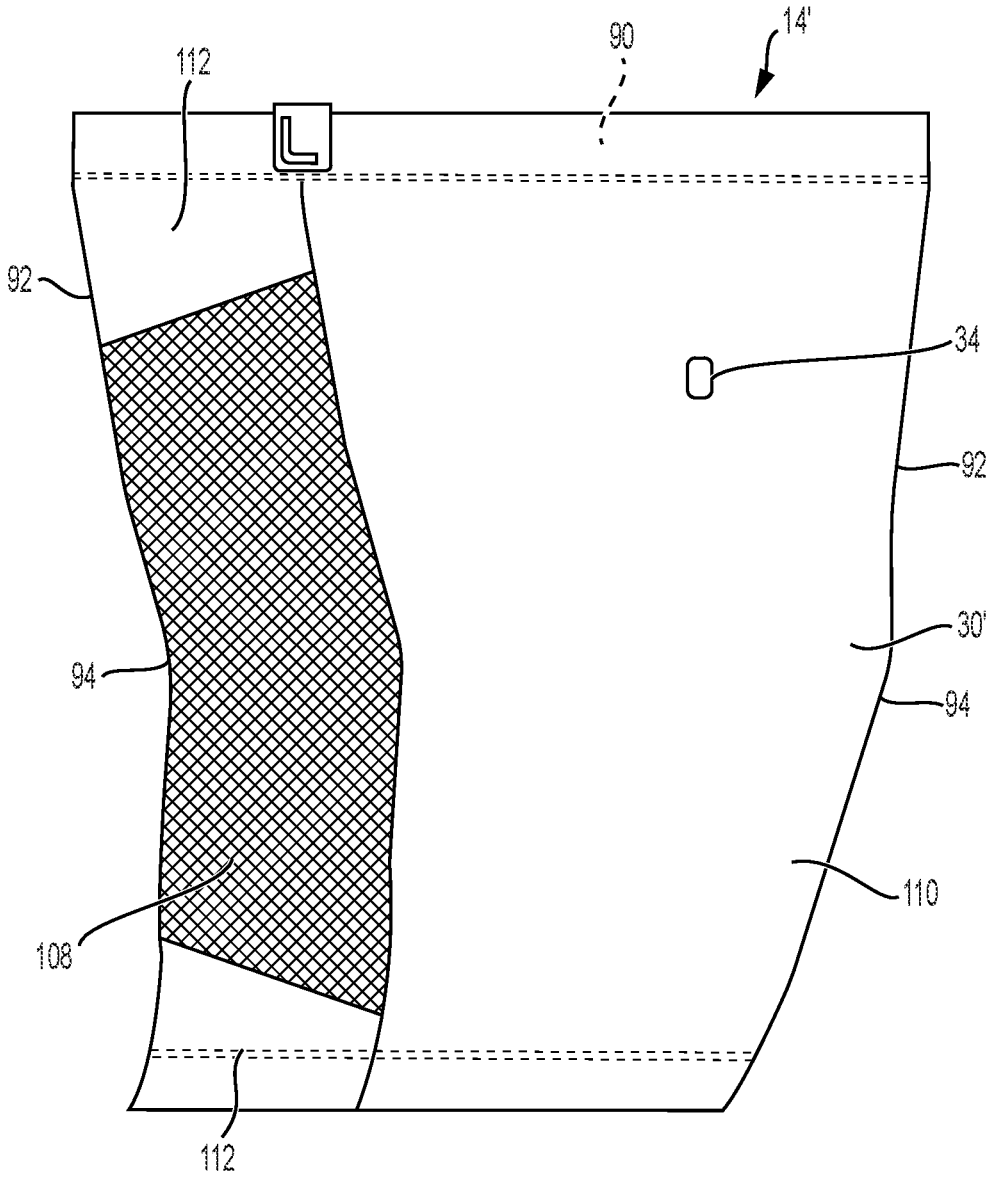
FIG. 12B illustrates the fabric laid flat prior to being sewn to form an alternative embodiment of the sleeve of FIG. 6.
Figure 13A:
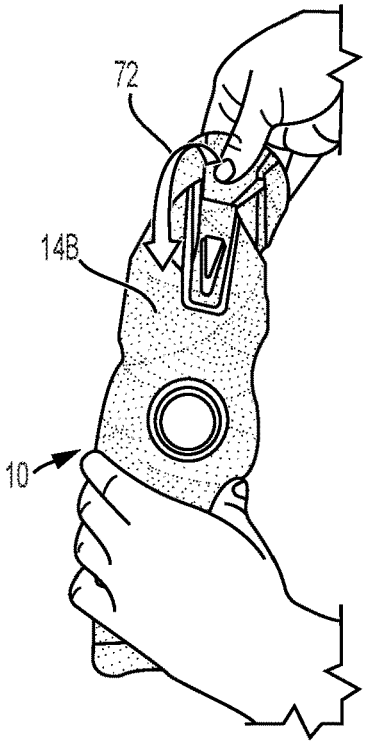
FIGS. 13A to 13H illustrate the steps for replacing the sleeve of the arm protector of FIG. 2.
Figure 13B:
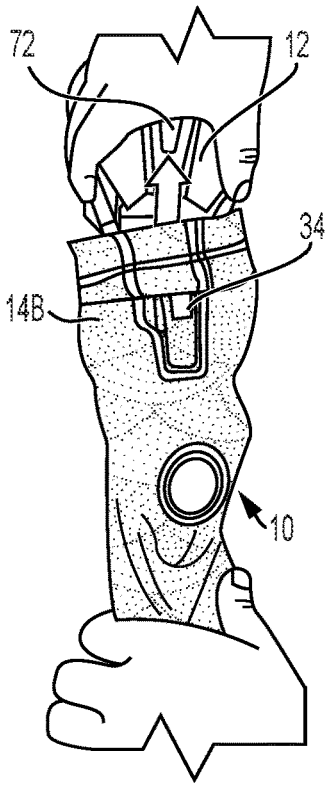
Figure 13C:
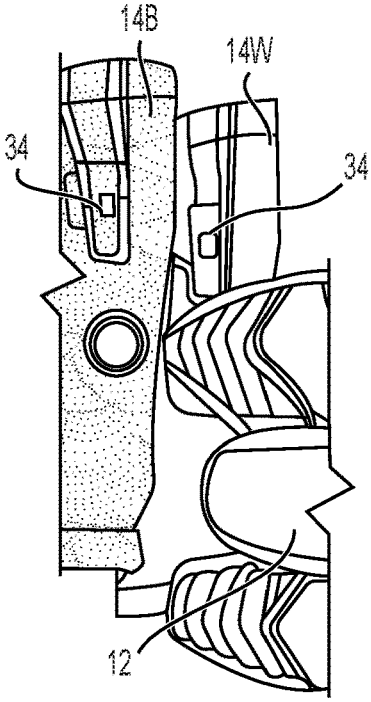
Figure 13D:
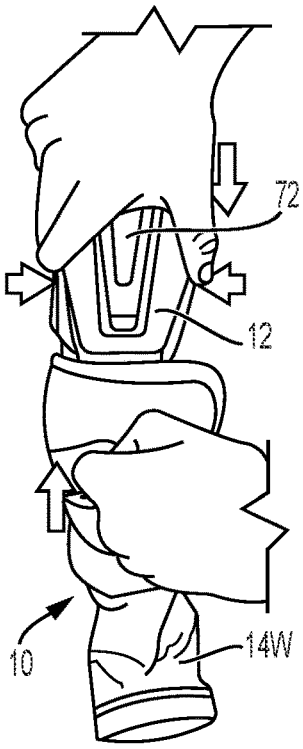
Figure 13E:
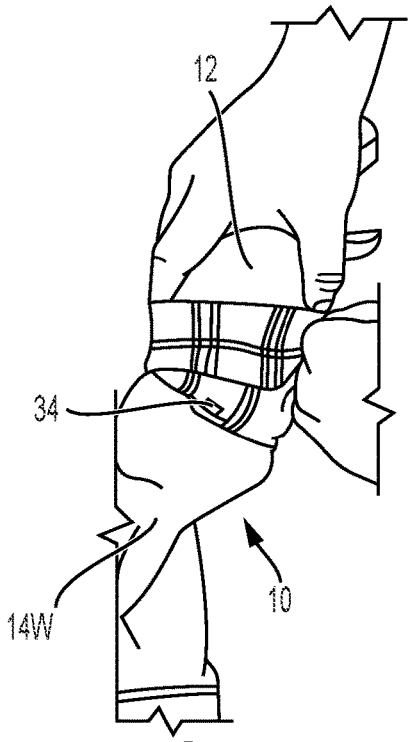
Figure 13F:
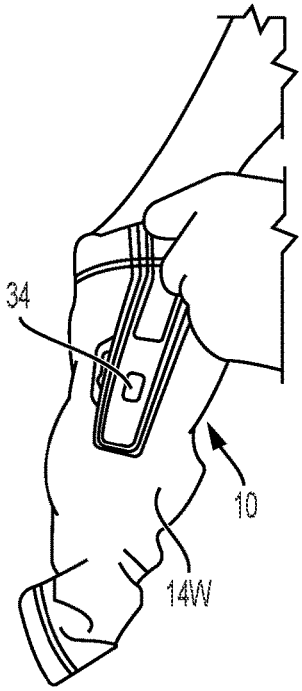
Figure 13G:
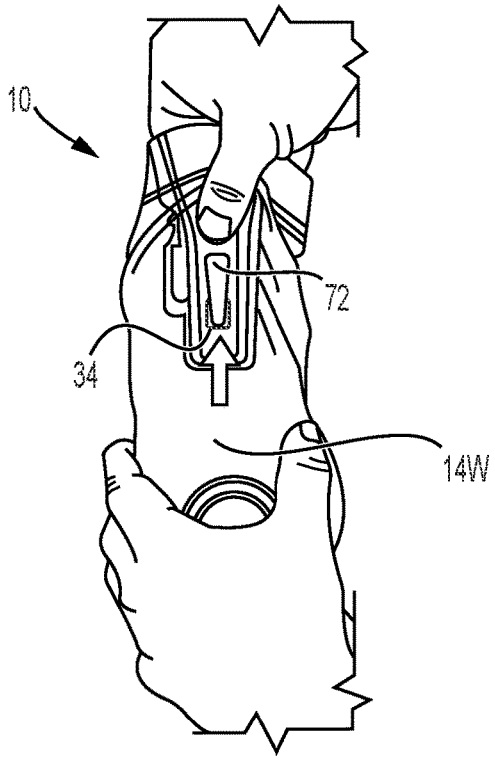
Figure 13H:
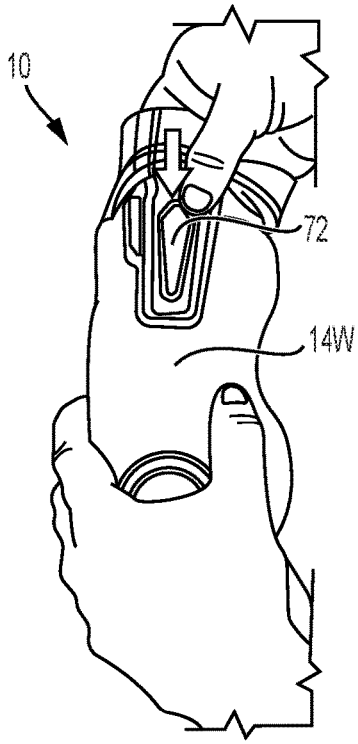
Figure 14B:
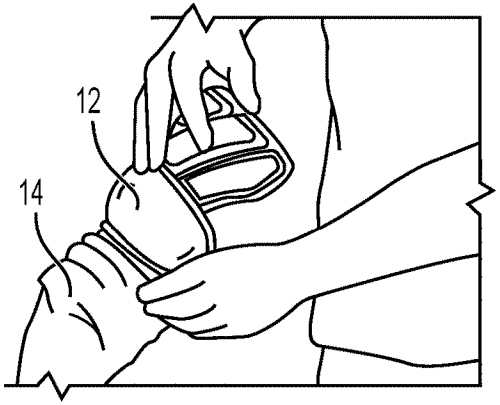
FIGS. 14A to 14D illustrate different steps of a life cycle of the arm protectors.
Figure 14D:
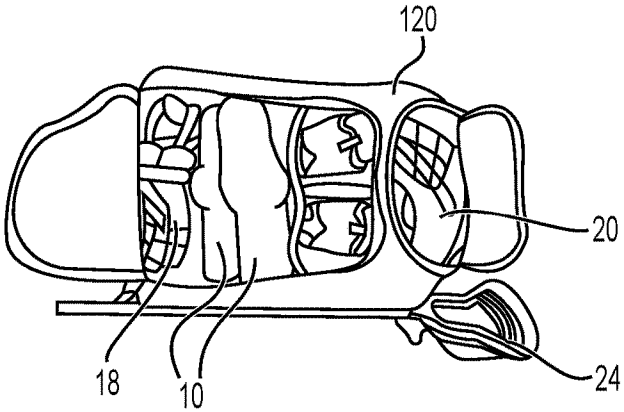
Figure 14A:
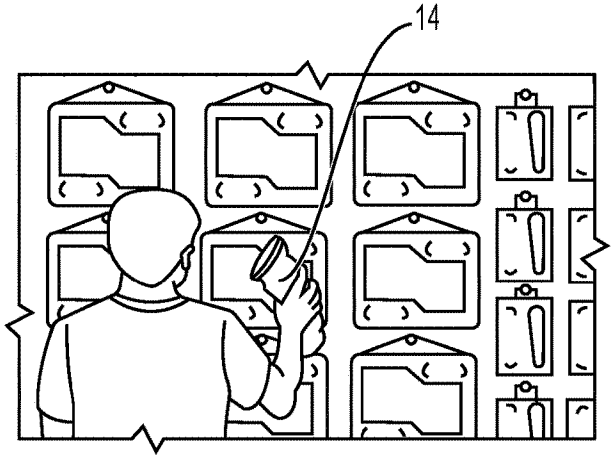
Figure 14C:
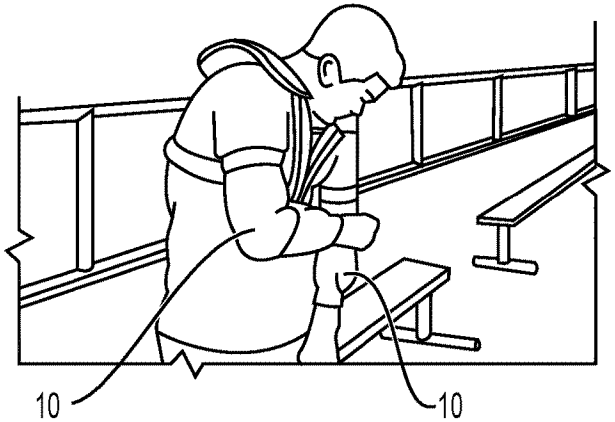

FIG. 12B illustrates a sheath body 30' prior to being sewn for forming a generally tubular sleeve 14' that is an alternative embodiment of the sleeve 14. The elements of the sleeve 14' that correspond to the elements of the arm sleeve 14 have been labeled with the same reference numerals as those of the sleeve 14 and will not be described again in detail. The sheath body 30' has a portion 108 made from a first material, and portions 110, 112 made from a second material. The material of the portion 108 is less elastic than the material of the portions 110, 112. In the present embodiment, the material of the portions 110, 112 is the same material as the material of the sheath body 30. In one embodiment, the material of the portion 108 is a mesh material. The portion 108 is disposed adjacent the seam 96 resulting from the side edges 92 being sewn together to form the sleeve 14'. With the arm guard 12 received in the sleeve 14', most of the portion 108 is circumferentially offset from the arm guard 12. In other words, most of the portion 108 extends along the part of the sleeve 14' that extends between the sides of the arm guard 12 and that does not abut the arm guard 12. As such, the portion 108 is less elastic than the portion 110 of the sheath body 30' that is circumferentially aligned with the arm guard 12.

Turning now to FIGS. 13A to 13H, a method for replacing the sleeve 14 of the arm protector 10 will be described. In this example, the arm protector 10 is initially provided with a black sleeve 14B that is to be replaced by a white sleeve 14W. Other than their colors, the sleeves 14B, 14W are the same and are also the same as the sleeve 14 described above. The method begins at FIG. 13A, where the top of the sleeve 14B is pulled so as to pass the sheath aperture 34 up and over the pin head 72 to release the sleeve 14B. Then at FIG. 13B, the arm guard 12 is pinched and pulled out from the top of the sleeve 14B while pulling down on the sleeve 14B. Then at FIG. 13C, the sleeve 14B is put away and the sleeve 14W corresponding to the side of the arm protector 10 (i.e., the left side in this case) is selected. Then at FIG. 13D, the arm guard 12 is pinched and pushed into the sleeve 14W via the top of the sleeve 14W while pulling up on the sleeve 14W. At this step, the arm guard 12 is to be oriented such that the forearm pad 36 is inserted first in the sleeve 14W. Then at FIG. 13E, the arm guard 12 is pushed down into the sleeve 14W. Then at FIG. 13F, once the arm guar 12 is fully in the sleeve 14W, the positions of the arm guard 12 and of the sleeve 14W are adjusted such that the sheath aperture 34 in the sleeve 14 is aligned with the pin 32. Then at FIG. 13G, the lower end of the pin head 72 is inserted in the sheath aperture 34 and the sleeve 14W is pulled so as to pass the sheath aperture 34 up and over the pin head 72 to engage the sleeve 14W with the arm guard 12. Finally at FIG. 13H, the portion of the sleeve 14W around the sheath aperture 34 is tucked under the pin head 72 to ensure proper engagement. Although in the present example one sleeve 14B is replaced with another sleeve 14W, the same method would be used to remove a sleeve 14 and reinstall the same sleeve 14, should this sleeve 14 need to be washed for example.

FIGS. 14A to 14D, different steps of a life cycle of the arm protectors 10 will be described. At FIG. 14A, when first purchasing the arm protectors 10, the player can select arm guards 12 and sleeves 14 from a plurality of different arm guards 12 and sleeves 14 to create a desired pairing of arm guards 12 and sleeves 14 for making the desired arm protector 10. At the same time or at a later time, the player can select additional sleeves 14, in a different color for example, to be used with the same arm guards 12. Similarly, at the same time or at a later time, the player can select additional arm guards 12, in a different model, such as the arm guard 12' described above, to be used with the same sleeves. Also, should the arm guard 12 or the sleeves 14 become worn or damaged, the player can only purchase new arm guards 12 or new sleeves 14, and not the entire arm protectors. At FIG. 14B, once the arm guards 12 and the sleeves 14 have been selected, the arm guards 12 are inserted in the sleeves 14 as described above with respect to FIGS. 13D to 13H. At FIG. 14C, the player puts on the assembled arm protectors 10 by simply sliding their arms inside the arm protectors 10. The compression provided by the elastic material of the sheath body 30 keeps the arm protectors 10 in place. At FIG. 14D, when they are not in use, the player can put the assembled arm protectors 10 in a bag 120, or any other storage, together with the rest of their equipment until the next time they need to be used. Should the sleeves 14 need to be washed, they can be removed as described above with respect to FIGS. 13A and 13B, washed, and then put back on the sleeves 14 as described above.

Figure 16:
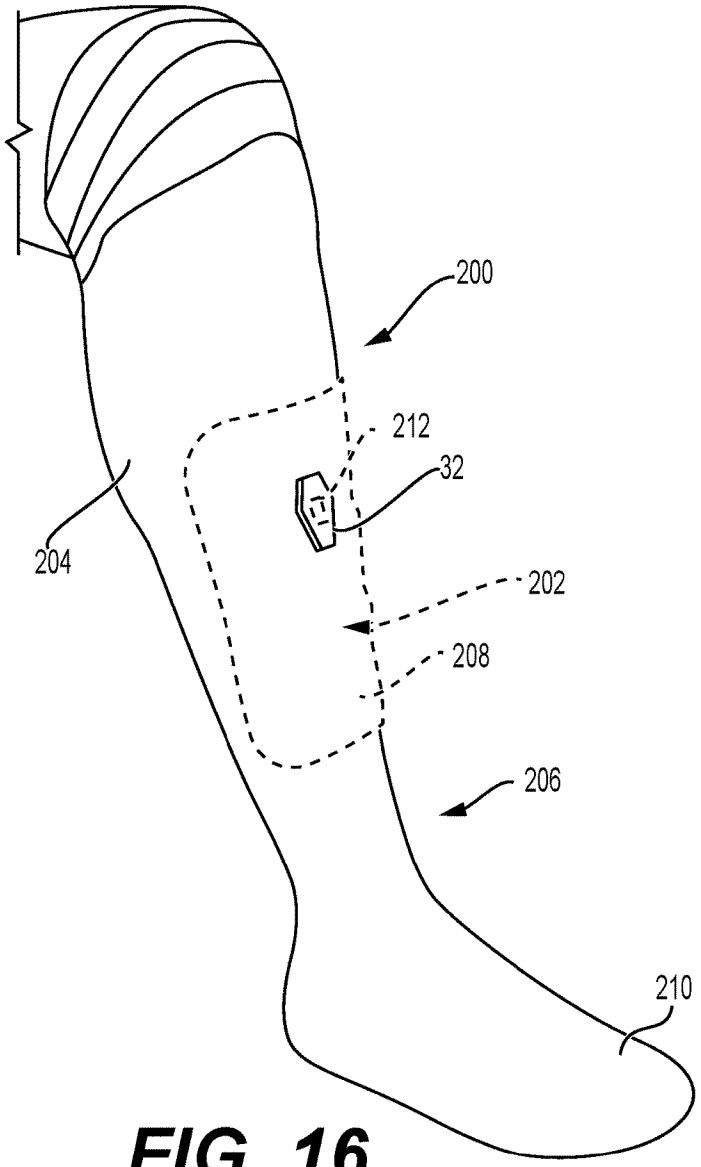
FIG. 16 illustrate a shin protector according to the present technology having a sock and the shin guard of FIG. 15.
Figure 15:
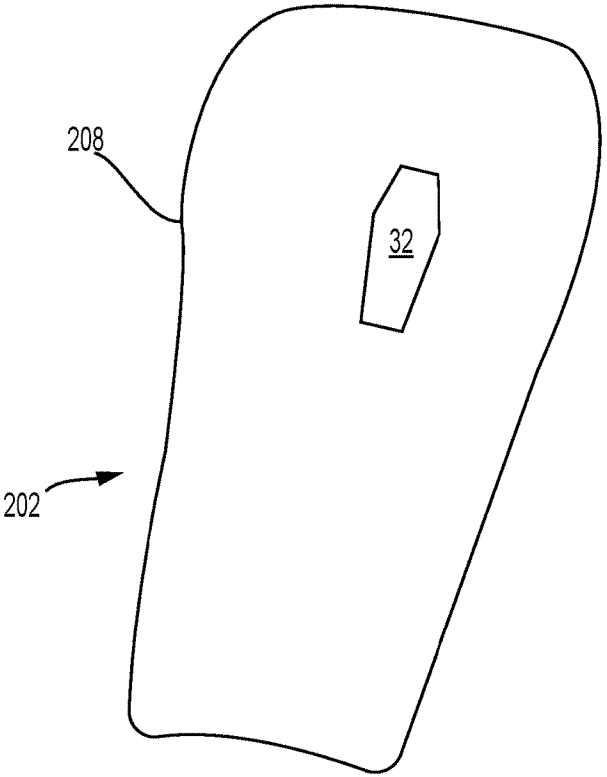
FIG. 15 illustrates a shin guard according to the present technology.

Turning now to FIGS. 15 and 16, the shin protector 200 will be described in more detail. As described above, the shin protector 200 has a shin guard 202 and a sock 206. The shin guard 202 has a shin pad 208 with a pin 32 connected to and extending from an external side of the shin pad 208. The pin 32 is the same as the pin 32 described above. It is contemplated that a pin 32 different from the pin 32 could be provided. The sock 206 has a leg portion 204 connected to a foot portion 210. The leg portion 204 defines a sheath aperture 212 on a front thereof.

To put on the shin protector 200, the player puts the shin guard 202 against their shin and then puts on the sock 200 over the shin guard 202. As they put on the sock 200, the player inserts the pin 32 through the sheath aperture 212. Alternatively, the player can place the shin guard 202 inside the leg 204 and insert the pin 32 through the sheath aperture 212 before putting on the sock 200. The player can then put on the sock 200 with the shin guard 202 attached to it. The sock 200 is made of elastic material so as to compress the shin pad 208 against the player's shin when worn.

Modifications and improvements to the above-described embodiments of the present invention may become apparent to those skilled in the art. The foregoing description is intended to be exemplary rather than limiting. The scope of the present technology is therefore intended to be limited solely by the appended claims.

What is claimed is:

1. A limb protector comprising:

a sheath having at least one elastic portion, the sheath defining a sheath aperture in a side thereof; and a limb guard received in the sheath, the limb guard being removable from the sheath, the limb guard comprising:

a pad; and a pin connected to the pad, the pin extending from an external side of the pad, the pin extending through the sheath aperture.

2. The limb protector of claim 1, wherein the pin comprises:

a pin body having a first end and a second end, the first end of the pin body being connected to the pad, the pin body extending through the sheath aperture; and a pin head connected to the second end of the pin body.

3. The limb protector of claim 2, wherein:

the pad defines an internal recess;

the pin body extends through the pad;

the first end of the pin body is disposed in the internal recess; and the limb guard further comprises a retaining ring clipped on the first end of the pin body for connecting the pin body to the pad, the retaining ring being disposed in the internal recess.

4. The limb protector of claim 2, wherein:

the pad defines a channel on the external side thereof; and the pin head is disposed in the channel.

5. The limb protector of claim 2, wherein:

the pin head is larger than the sheath aperture; and a portion of the sheath surrounding the sheath aperture is disposed between the pin head and the pad.

6. The limb protector of claim 2, wherein the pin body is connected to the pin head at a point offset from a center of the pin head.

7. The limb protector of claim 1, wherein the sheath comprises a plastic film around the sheath aperture for reinforcing the sheath around the sheath aperture and for reducing an elasticity of the sheath around the sheath aperture.

8. The limb protector of claim 1, wherein the at least one elastic portion of the sheath comprises:

a first elastic portion circumferentially aligned with the limb guard, the sheath aperture being defined in the first elastic portion; and a second elastic portion circumferentially offset from the limb guard, the second elastic portion being less elastic than at least a majority of the first elastic portion.

9. The limb protector of claim 1, wherein the pad is disposed completely inside the sheath.

10. The limb protector of claim 1, wherein:

the sheath has a longitudinal seam;

the longitudinal seam is circumferentially offset from the limb guard; and the longitudinal seam is non-linear such that a first end of the longitudinal seam is circumferentially offset from a second end of the longitudinal seam.

11. The limb protector of claim 1, wherein:

the limb protector is an arm protector;

the sheath is a sleeve; and the limb guard is an arm guard.

12. The limb protector of claim 11, wherein:

the pad is a bicep pad; and the arm guard further comprises:

an elbow cap connected to the bicep pad; and a forearm pad connected to the elbow cap, the elbow cap being disposed between the bicep pad and the forearm pad.

13. An arm guard comprising:

a bicep pad;

a pin connected to the bicep pad, the pin extending from an external side of the bicep pad;

an elbow cap connected to the bicep pad; and a forearm pad connected to the elbow cap, the elbow cap being disposed between the bicep pad and the forearm pad.

14. The arm guard of claim 13, wherein the pin comprises:

a pin body having a first end and a second end, the first end of the pin body being connected to the pad; and a pin head connected to the second end of the pin body.

15. The arm guard of claim 14, wherein:

the bicep pad defines an internal recess;

the pin body extends through the bicep pad;

the first end of the pin body is disposed in the internal recess; and the arm guard further comprises a retaining ring clipped on the first end of the pin body for connecting the pin body to the bicep pad, the retaining ring being disposed in the internal recess.

16. The arm guard of claim 14, wherein:

the bicep pad defines a channel on the external side thereof; and the pin head is disposed in the channel.

17. The arm guard of claim 14, wherein the pin body is connected to the pin head at a point offset from a center of the pin head.

18. A sheath for a limb protector comprising:

a generally tubular sheath body configured for receiving a limb guard therein, the sheath body having at least one elastic portion, the sheath body defining a sheath aperture in a side thereof, the sheath aperture being configured for receiving therethrough a pin of the limb guard.

19. The sheath of claim 18, further comprising a plastic film disposed on the sheath body around the sheath aperture for reinforcing the sheath body around the sheath aperture and for reducing an elasticity of the sheath body around the sheath aperture.

20. The sheath of claim 18, wherein the at least one elastic portion of the sheath body comprises:

a first elastic portion configured to be circumferentially aligned with the limb guard, the sheath aperture being defined in the first elastic portion; and a second elastic portion configured to be circumferentially offset from the limb guard, the second elastic portion being less elastic than at least a majority of the first elastic portion.

21. The sheath of claim 18, wherein:

the sheath body has a longitudinal seam; and the longitudinal seam is non-linear such that a first end of the longitudinal seam is circumferentially offset from a second end of the longitudinal seam.

* * * * *